US010391032B2

(12) United States Patent
Gobbi Frattini

(10) Patent No.: US 10,391,032 B2
(45) Date of Patent: Aug. 27, 2019

(54) STERILIZABLE FLEXIBLE PACKAGE FOR THE RECONSTITUTION AND ADMINISTRATION OF FLUID MEDICINAL OR NUTRITIONAL SUBSTANCES WHICH ARE INFUSED OR INSTILLABLE WITHIN THE BODY OF A PATIENT

(71) Applicant: PAOLO GOBBI FRATTINI S.R.L., Milan (IT)

(72) Inventor: Paolo Giuseppe Gobbi Frattini, Sondalo So (IT)

(73) Assignees: PAOLO GOBBI FRATTINI S.R.L., Milan (IT); ADIENNE PHARMA & BIOTECH SA, Lugano (CH)

( * ) Notice: Subject to any disclaimer, the term of this patent is extended or adjusted under 35 U.S.C. 154(b) by 342 days.

(21) Appl. No.: 15/287,235

(22) Filed: Oct. 6, 2016

(65) Prior Publication Data

US 2017/0100307 A1 Apr. 13, 2017

(30) Foreign Application Priority Data

Oct. 9, 2015 (IT) ..... 102015000060050

(51) Int. Cl.
*A61J 1/20* (2006.01)
*A61J 1/10* (2006.01)
(Continued)

(52) U.S. Cl.
CPC ..... *A61J 1/2093* (2013.01); *A61J 1/10* (2013.01); *A61J 1/1406* (2013.01); *A61J 1/1475* (2013.01); *A61J 1/1481* (2015.05); *A61J 1/1487* (2015.05); *A61J 1/201* (2015.05); *A61J 1/2027* (2015.05); *A61J 1/2051* (2015.05); *A61J 1/2055* (2015.05);
(Continued)

(58) Field of Classification Search
CPC ..... A61J 1/10; A61J 1/1406; A61J 1/1475; A61J 1/1481; A61J 1/1487; A61J 1/201; A61J 1/2027; A61J 1/2051; A61J 1/2055; A61J 1/2065; A61J 1/2093
See application file for complete search history.

(56) References Cited

U.S. PATENT DOCUMENTS 4,583,971 A * 4/1986 Bocquet ..... A61J 1/2089 604/414
10,010,481 B2 * 7/2018 Gobbi Frattini ... B65D 81/3216
2014/0352845 A1 * 12/2014 Lev ..... A61J 1/2089 141/329

FOREIGN PATENT DOCUMENTS

EP 0 091 310 A2 10/1983
EP 1 721 588 A1 11/2006
(Continued)

OTHER PUBLICATIONS

Italian Search Report, dated Jun. 16, 2016 (2 pages).

*Primary Examiner* — Benjamin J Klein
(74) *Attorney, Agent, or Firm* — Jacobson Holman, PLLC.

(57) ABSTRACT

There is described a package for the reconstitution and administration of fluid medicinal or nutritional substances which are infused or instillable within the body of a patient, comprising a flexible casing containing a vial of a medicinal or nutritional substance in a coupling position to a coupling and perforation device inserted into a mixing tube for the connection with a bag of liquid diluent. The casing comprises a connector provided with an openable and hermetically closable cap, adapted to introduce a mixture of sterilizing gas and oxygen into said casing.

7 Claims, 6 Drawing Sheets

(51) Int. Cl.
*A61J 1/14* (2006.01)
*B65D 81/32* (2006.01)

(52) U.S. Cl.
CPC ..... *A61J 1/2065* (2015.05); *A61J 1/2089* (2013.01); *B65D 81/3266* (2013.01)

(56) References Cited

FOREIGN PATENT DOCUMENTS

| | | | |
|---|---|---|---|
| EP | 2 455 058 | A1 | 5/2012 |
| EP | 2 962 676 | A1 | 1/2016 |
| GB | 2 117 733 | A | 10/1983 |
| WO | 2012/101101 | A1 | 8/2012 |
| WO | 2014/001226 | A1 | 1/2014 |

* cited by examiner

STERILIZABLE FLEXIBLE PACKAGE FOR THE RECONSTITUTION AND ADMINISTRATION OF FLUID MEDICINAL OR NUTRITIONAL SUBSTANCES WHICH ARE INFUSED OR INSTILLABLE WITHIN THE BODY OF A PATIENT

BACKGROUND OF THE INVENTION

The present invention relates to a sterilizable flexible package for the reconstitution and administration of fluid medicinal or nutritional substances which are infused or instillable within the body of a patient, and to a process for the sterilization thereof.

Packages are known for the infusion or instillation of medicinal or nutritional products within the body of a patient, comprising a bag of liquid diluent provided with at least one outlet tube provided with a closing device, and a mixing tube provided with an openable closure and ending with a coupling and perforation device for a vial of pharmacological or nutritional substance in the form of powder, gel or other material, provided with a perforable cap. Such packages further comprise a hermetically closable, sterile, flexible casing containing the bottle of the powdered substance or other, and the coupling and perforation device.

Such packages allow the vial to be manually handled from the outside of the casing from a coupling position to the position of perforation of the cap through the coupling and perforation device, thus ensuring sterility conditions when the vial containing the powdered medicinal or nutritional substance is perforated to be connected to the mixing tube extending from the bag.

However, the current processes for sterilizing the aforesaid flexible packages imply high costs since they require the presence of suitable sterilization chambers and also involve complex steps.

GB 2 117 733 A1 discloses a package according to the preamble of claim 1.

In light of the problems above, it is the object of the present invention to provide a package of the aforesaid type, which is sterilizable by means of an innovative sterilization process which is simple and affordable.

BRIEF SUMMARY OF THE INVENTION

According to the invention, such an object is achieved by means of a package for the reconstitution and administration of fluid medicinal or nutritional substances which are instillable within the body of a patient.

A process according to the present invention in turn comprises:

- introducing a mixture of sterilizing gas and oxygen into said casing through a connector provided with a non-return valve,
- leaving the mixture of sterilizing gas and oxygen inside the casing for a certain period of time,
- removing the mixture of sterilizing gas and oxygen from said casing through the connector provided with a cap with non-return valve, possibly creating a vacuum inside the casing.

BRIEF DESCRIPTION OF THE DRAWINGS

The features of the present invention will become apparent from the following detailed description of a preferred embodiment thereof, shown by way of example in the accompanying drawings, in which:

FIG. 1 shows a package 100, according to the present invention, for the infusion or instillation of medicinal or nutritional products within the body of a patient.

Figure 1:
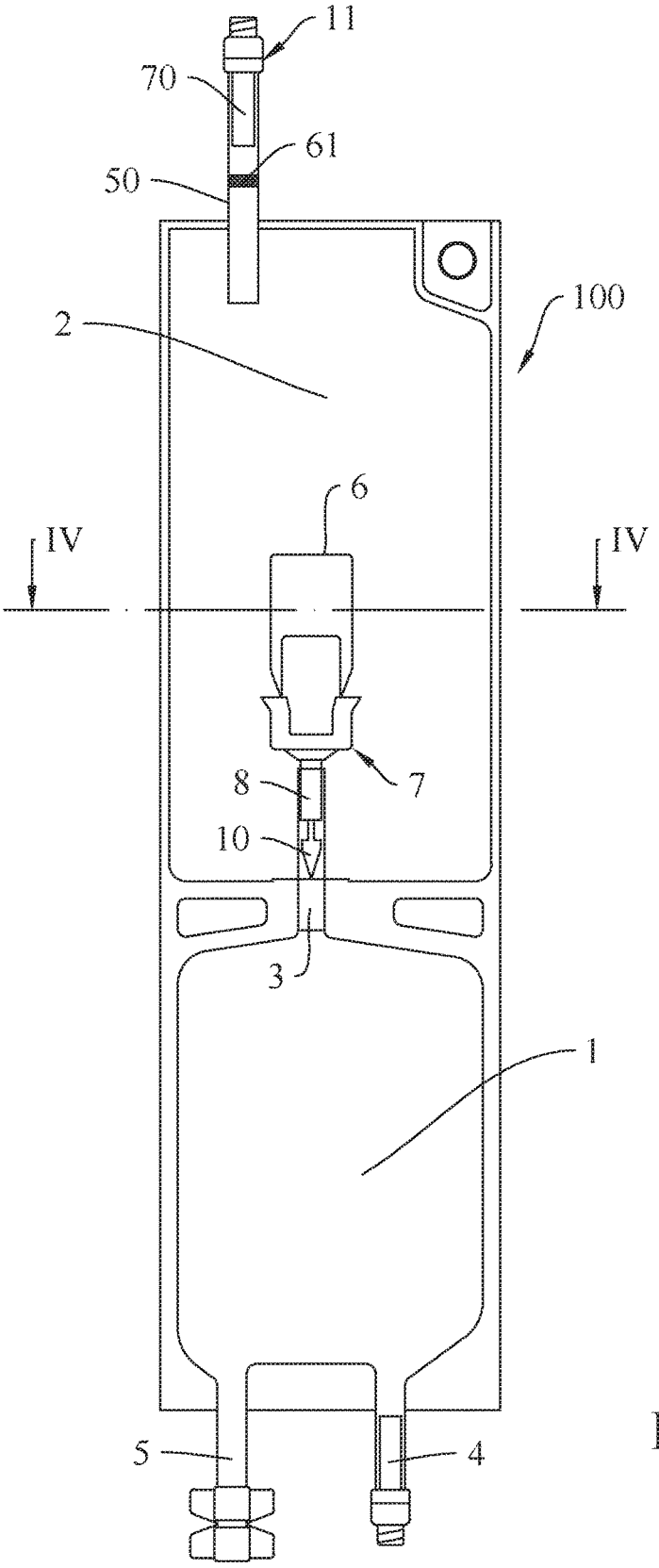
FIG. 1 shows a flexible package, according to the present invention, comprising a bag of liquid diluent and a casing provided with a connector for the sterilization and having a vial of powdered pharmacological or nutritional substance or other therein, and a coupling and perforation device.
Figure 2:
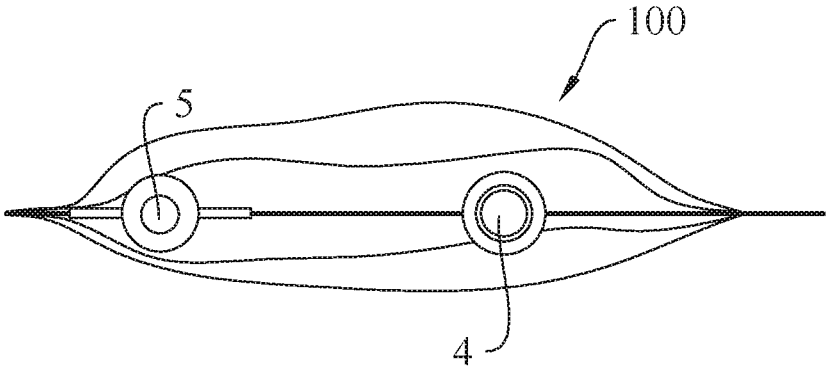
FIGS. 2, 3 show a bottom view and a top view, respectively, of the package in FIG. 1.
Figure 3:
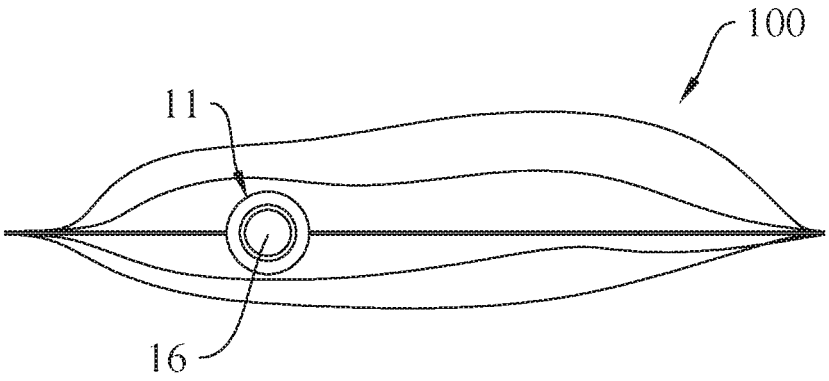
Figure 4:
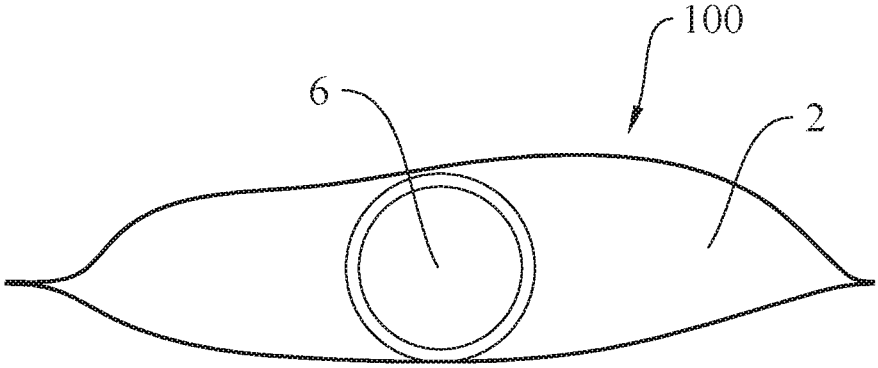
FIG. 4 shows a sectional view according to line IV-IV, of the package in FIG. 1.

Package 100 (FIG. 1) essentially comprises a bag 1 of liquid diluent and a flexible sterile casing 2, joined together but with separate internal compartments.

Said bag 1 is provided with at least one mixing tube 3 adapted to introduce a pharmacological or nutritional substance into bag 1, with at least one inlet tube 4 adapted to be connected to a specific dose syringe (not shown in the figures), and with at least one outlet tube 5 with a connection end for a catheter or dosing set adapted to cause the flow of the reconstituted solution given by the mixture of pharmacological or nutritional substance and liquid diluent for the infusion or instillation.

Figure 7:
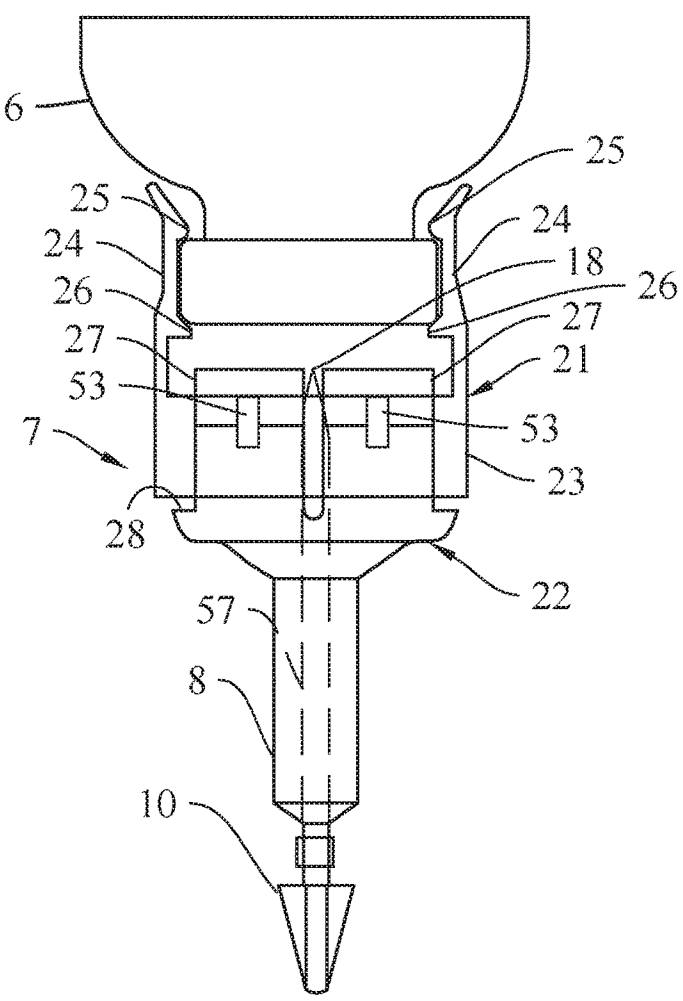
FIGS. 6, 7 show a first and a second view with partial cross section of the vial in coupling position to the coupling and perforation device.
Figure 6:
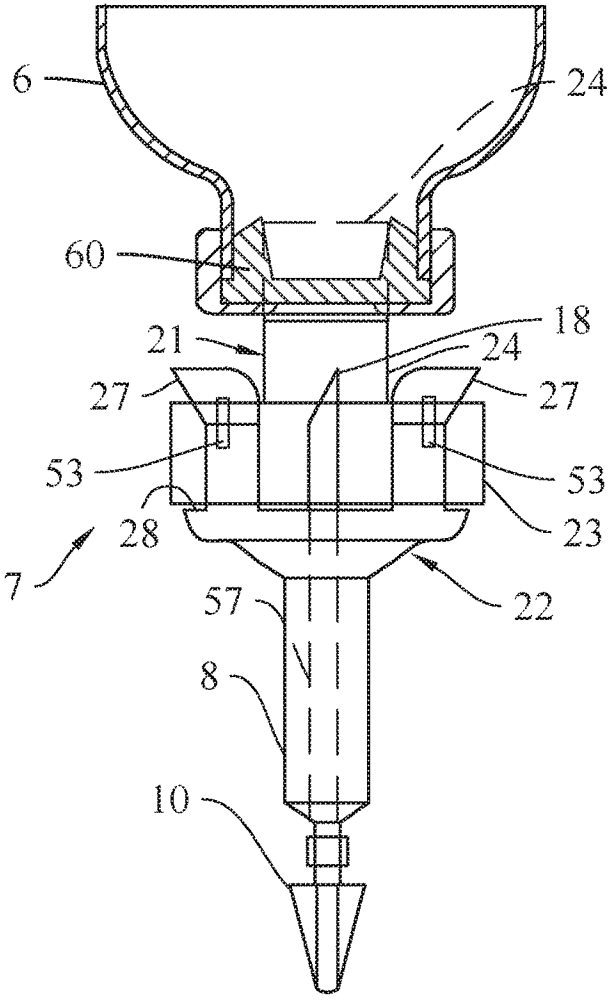

Said casing 2 comprises a vial 6 therein with a cap 60 (FIG. 6) containing a pharmacological or nutritional substance in the form of powder, gel or other material; vial 6 is in coupling position with a coupling and perforation device 7 (FIGS. 6, 7) which is for example of the type disclosed in EP 2 962 676 A1. The coupling and perforation device 7 has an internal channel 57 ending at the top with a hollow tip 18. The coupling and perforation device 7 comprises, at the bottom, an openable closure 8 of said internal channel 57 which is inserted into the mixing tube 3 for connecting vial 6 to bag 1.

The openable closure 8 acts as a frangible cap for the mixing tube 3, having an initial point-shaped portion 10, which is susceptible to breaking if manually bent. This operation opens channel 57 and allows the connection, through the mixing tube 3, between vial 6 and bag I of liquid diluent, for the introduction of the powdered pharmacological or nutritional substance into bag 1.

Figure 9:
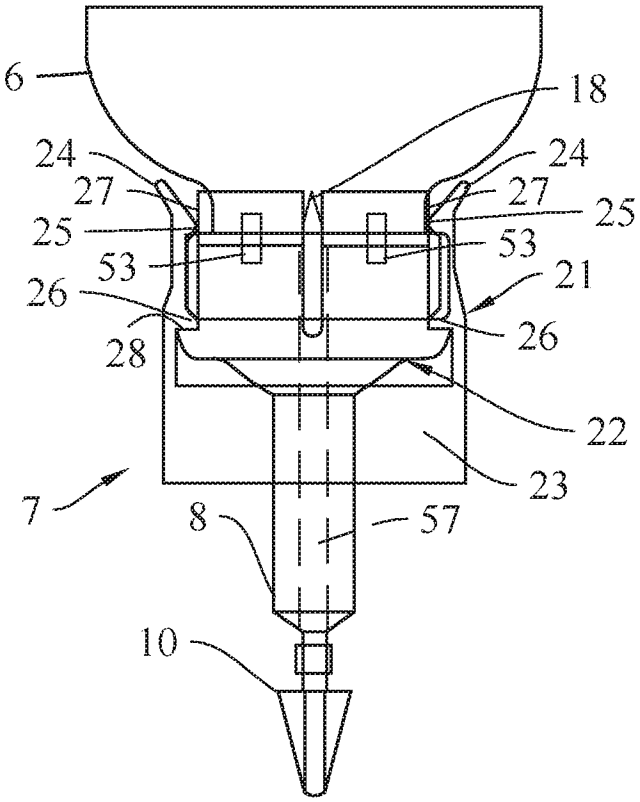
FIGS. 8, 9 show a first and a second view with partial cross section of the vial in perforating position.
Figure 8:
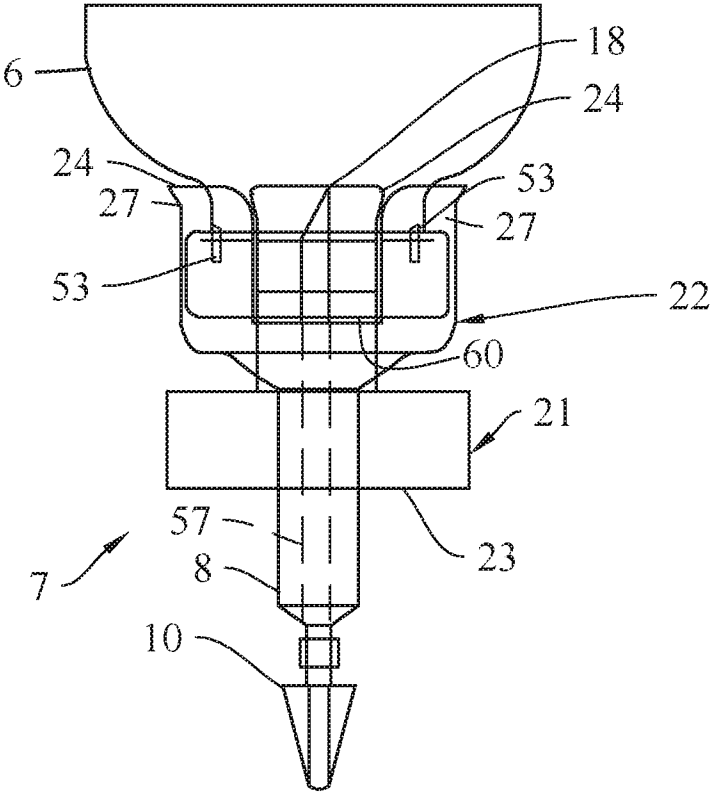

As also shown in FIGS. 6-9, the coupling and perforation device 7 comprises a first element 21 slidably coupled to a second element 22 and movable between a coupling position of vial 6 (FIGS. 6, 7) and a position of perforation, of the cap 60 of vial 6 (FIGS. 8, 9).

The first element 21 (FIGS. 6 to 9) comprises a ring 23 from which at least two flaps 24, provided with notches 25, 26 adapted to accommodate vial 6 in the coupling position, vertically branch off.

The openable closure 8 of the second element 22 is surmounted by a circular base 28 from which further flaps 27 perimetrally branch off, being placed vertically in pairs and in turn provided with notches 53 adapted to accommodate vial 6 in the position of perforation of cap 60. There are gaps (not shown in the figure) between said pairs of further flaps 27, which are located at said flaps 24 of the first element 21 and are adapted to accommodate the flaps 24 with vial 6 when the coupling and perforation device 7 is in the position of perforation of cap 60.

Ring 23 is externally inserted on said further flaps 27 and is configured to slide coaxially with respect to the circular base 28. The further flaps 27 have a curvature at their free ends such as to form a first limit for the first element 21 at vial 6 in the coupling position, and the notches 26 are configured to contrast with said circular base 28 and to form a second limit of the first element 21 at vial 6 in the position of perforation of the cap 60 of vial 6.

Due to the characteristic flexibility of casing 2, vial 6 may be manually handled from the outside of casing 2 from the coupling position to a perforating position of the cap 60 of vial 6 through the coupling and perforation device 7 itself.

In particular, vial 6 is manually pressed from the outside just enough so that the notches 26 of ring 23, which slides coaxially with respect to the circular base 28, contrast with the circular base 28 itself and the hollow tip 18 perforates the closing cap 60 of vial 6. The portion 10 of the openable closure 8 is then broken, whereby the liquid diluent may flow from bag 1 into vial 6.

Moreover, said casing 2 comprises an upper tube 50, which protrudes from the upper end of casing 2, into which a connector 11 may be introduced, which in turn comprises a tubular body 70 of relatively rigid material, which can be engaged in tube 50 which is closed at the top by an openable and hermetically closable cap 12 adapted to introduce a mixture of sterilizing gas and oxygen into said casing 2. The sterilizing gas may be ozone or any other gas with bactericidal or virucidal features, for example; said mixture may be supplied from a specific ozone generator through a tube ending with a shank without needle.

In particular, cap 12 of plastic material may be that disclosed in WO 2012/101101 A1 entitled "Hermetic connector, pierceable without needle and automatically and sealingly reclosable, for devices intended for collecting and dispensing liquid solutions for pharmaceutical and/or nutritional use".

Figure 5:
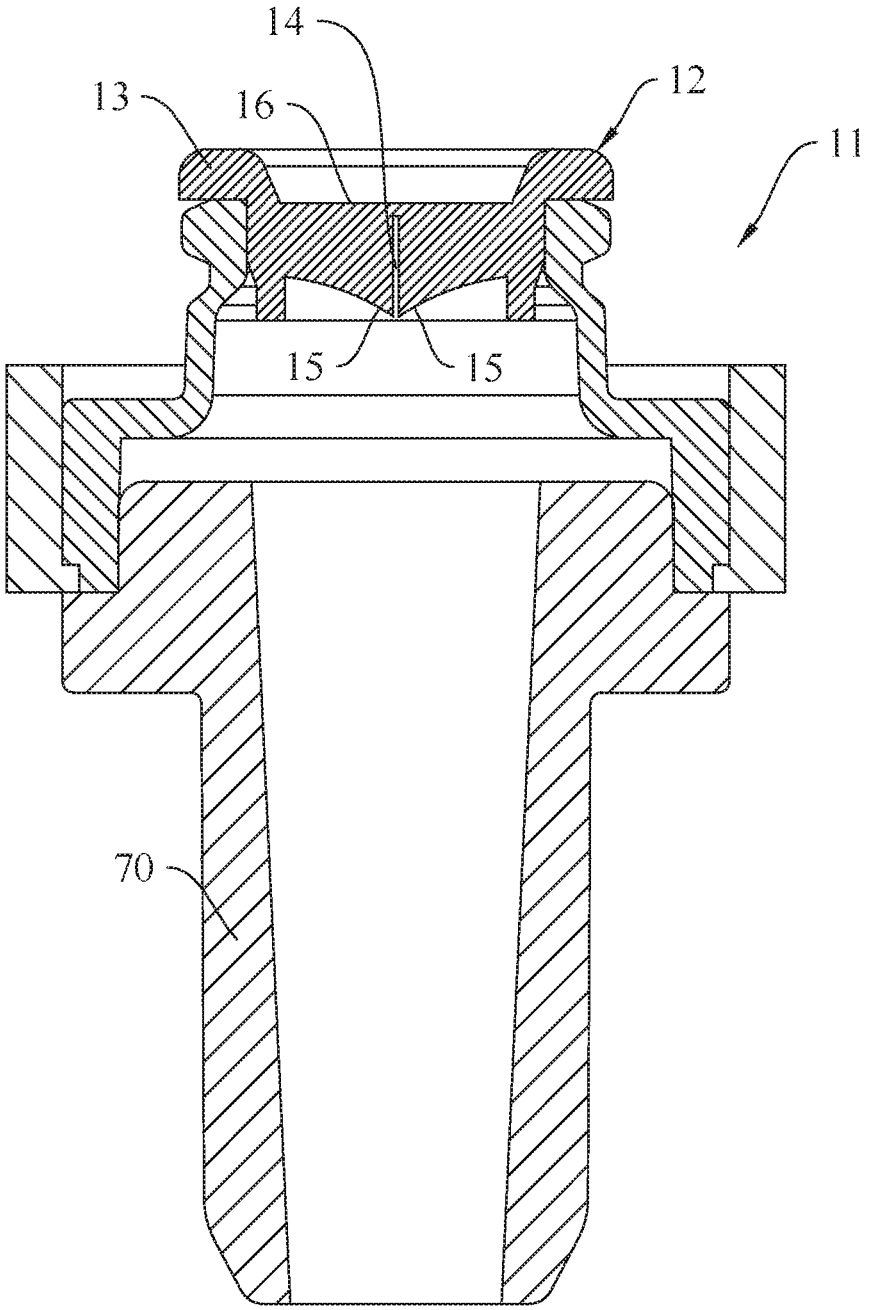
FIG. 5 shows an axial sectional view of the connector of the package in FIG. 1.

As shown in FIG. 5, cap 12 comprises a body 13 of elastically deformable plastic material, which is longitudinally crossed by a thin hole 14 with a rectangular section, and has at one end a pair of elastically openable and closable lips 15 which together form a non-return valve. At the other end, there is provided in central position a perforable and elastically resealable, thin, elastic membrane 16 which closes the longitudinal hole 14 and laterally continues to form a collar suitable for supporting and being fixed to connector 11. Membrane 16 is made in a single piece with body 13.

In the sterilization process, with package 100 in the condition shown in FIGS. 1-4, 6, 7, said mixture of ozone or other sterilizing gas and oxygen is introduced into said casing 2 through connector 11 which is first hermetically closed by cap 12. When said mixture is introduced, a shank without needle is forced against the thin central membrane 16 of the cap 12 of connector 11, which is thus perforated, thereby allowing the longitudinal hole 14 to be accessed, which longitudinal hole 14 expands accordingly.

Continuing, the shank causes the opening of the lips 15 thus accessing the interior of connector 11 for the introduction of the mixture into casing 2. The concentration of sterilizing gas—in any case quite small compared to the oxygen—may vary according to the production times of package 100. At this point, said mixture of sterilizing gas, in particular ozone, and oxygen is allowed to act for a predetermined period of time After such a period of time, the mixture of ozone or other sterilizing gas and oxygen is removed from casing 2 through the tube with shank used in the introduction step, and a vacuum may possibly be created inside casing 2.

When the operation is complete, the shank is retracted along hole 14 thus implying the elastic reclosing of the lips 15, and is then extracted therefrom with the subsequent reclosing of membrane 16. Therefore, cap 12 forms as a whole a non-return valve which ensures a hermetic closure of casing 2, which maintains the sterility thereof.

In order to obtain a 100% hermetic reclosing, a further embodiment could be to provide a weld 61 (FIG. 1) on the end part of tube 50 to then possibly cut tube 50 above weld 61 after the extraction of connector 11 and the reclosing of membrane 16.

Even if the package according to the invention has been described until now as usable for reconstitution and administration of medicinal or nutritional substances, its use is also possible for preparation of cellular inoculation. In such a case, an amount of cells in lyophilized form or in liquid suspension or in any other form according to the type of cells and the conservation method, for example in for of glycerinate maintained at T<−20° C. The bag 1 should be filled with a culture medium, that is a culture soil for causing growth of the cells, for example tryptic soy or MEM. Once the vial has been hooked to the coupling device 7, the upper part of the casing 2 shall be closed by welding or both sides adhesive tape. The reconstitution process remains unchanged.

The operation of infusion and instillation of "medicinal or nutritional substances" into the patient should be intended as comprising also cell inoculation.

The invention claimed is:

1. A package for reconstitution and administration of fluid medicinal or nutritional substances which are infused or instillable within the body of a patient, comprising a flexible casing containing a vial with closing cap for medicinal or nutritional substance, which vial is in coupling position with a coupling and perforation device inserted into a mixing tube for the connection with a bag of liquid diluent, wherein said coupling, and perforation device comprises a first element slidably coupled with a second element and movable between a vial coupling position and a vial cap perforating position, wherein said first element comprises a ring from which at least two flaps vertically extend which are provided with notches suitable to receive the vial in engagement position, and an operable closure surmounted by a circular base from the perimeter of which further adjacent flaps vertically extend, which are equipped with notches suitable to accommodate the vial in the vial cap perforating position, and said ring is inserted outside said additional flaps and is configured to slide coaxially with respect to the circular base, and said further flaps have a curvature at their free ends such as to constitute a first limit for said first element with respect to the vial in the vial coupling position, and said notches are configured to contrast with said circular base and form a second limit for said first element with respect to the vial in the vial cap perforating position, wherein said flexible casing further comprises a connector provided with an openable and hermetically reclosable cap, suitable for the introduction of a mixture of sterilizing gas and oxygen within said casing.

2. The package according to claim 1, wherein said cap comprises a body of elastically deformable plastic material, which is longitudinally crossed by a thin hole with a rectangular section and presents at one end a pair of elastically openable and closable lips which together form a non-return valve, another end being provided in a central position with a perforable and elastically resealable thin elastic membrane that closes the longitudinal hole and laterally forms a collar suitable for the support and the fixing of the connector.

3. The package according to claim 2, wherein said connector is fixed to a sealable tube which protrudes from an upper end of the casing.

4. The package according to claim 1, wherein said further flaps of the second element externally comprise locking notches suitable to lock the first element in the coupling position of the vial or bottle.

5. The package according to claim 1, wherein said openable closure of the coupling and perforation device has an internal channel ending at the top with a hollow tip and inferiorly with an initial portion which is frangible to allow passage of medical or nutritional substance coming from the vial through the mixing tube towards, the bag of liquid diluent.

6. The package according to claim 1, wherein the vial is filled with cells in lyophilized form or in liquid suspension and the bag is filled with a culture medium.

7. The package according to claim 1, wherein the upper part of the casing is sealable by welding or by adhesive tape.

* * * * *